US005620661A

United States Patent [19]

Schürbrock

[11] Patent Number: 5,620,661

[45] Date of Patent: Apr. 15, 1997

[54] PIPETTE SYSTEM

[75] Inventor: Klaus Schürbrock, Hamburg, Germany

[73] Assignee: Eppendorf-Netherler-Hinz GmbH, Hamburg, Germany

[21] Appl. No.: 353,752

[22] Filed: Dec. 12, 1994

[30] Foreign Application Priority Data

Dec. 10, 1993 [DE] Germany ..... 43 42 178.4

[51] Int. Cl.[6] ..... B01L 3/02

[52] U.S. Cl. ..... 422/100; 73/864.16; 73/864.18; 222/287; 222/288; 222/326

[58] Field of Search ..... 73/864.18, 864.16; 422/99, 100; 222/287, 288, 326

[56] References Cited

U.S. PATENT DOCUMENTS

| | | | |
|---|---|---|---|
| 4,406,170 | 9/1983 | Küln | 73/864.16 |
| 4,905,526 | 3/1990 | Magnussen, Jr. et al. . | |
| 4,988,481 | 1/1991 | Jarvimaki et al. . | |
| 5,002,737 | 3/1991 | Tervamaki | 422/100 |
| 5,336,467 | 8/1994 | Heidt | 422/64 |
| 5,343,769 | 9/1994 | Suovaniemi | 73/864.18 |

FOREIGN PATENT DOCUMENTS

| | | |
|---|---|---|
| 2926691 | 5/1983 | Germany . |
| 671526 | 9/1989 | Switzerland . |

*Primary Examiner*—Long V. Le
*Attorney, Agent, or Firm*—Anderson Kill & Olick P.C.

[57] ABSTRACT

A pipette system with a syringe comprising a syringe flange and a syringe plunger, and with a pipette which in a pipette body comprises an accommodation for the syringe flange and in an accommodation body comprises a plunger accommodation for the syringe plunger, further comprising fastening mechanism for releasably fixing the syringe flange and the syringe plunger to their accommodations, and plunger adjusting device for displacing the accommodation body within the pipette body, the syringe comprising a data carrier with an information about the syringe and/or the condition thereof, and the pipette comprising a sensing device for the information on the data carrier, the syringe flange and the syringe plunger being axially movable into their positions of attachment in the pipette through axial openings of their accommodations, the data carrier being placed into a sensing position with respect to the sensing device and the syringe flange comprising a ring having at least one axially directed sensed area as a data carrier in an axial position.

19 Claims, 4 Drawing Sheets

FIG.10
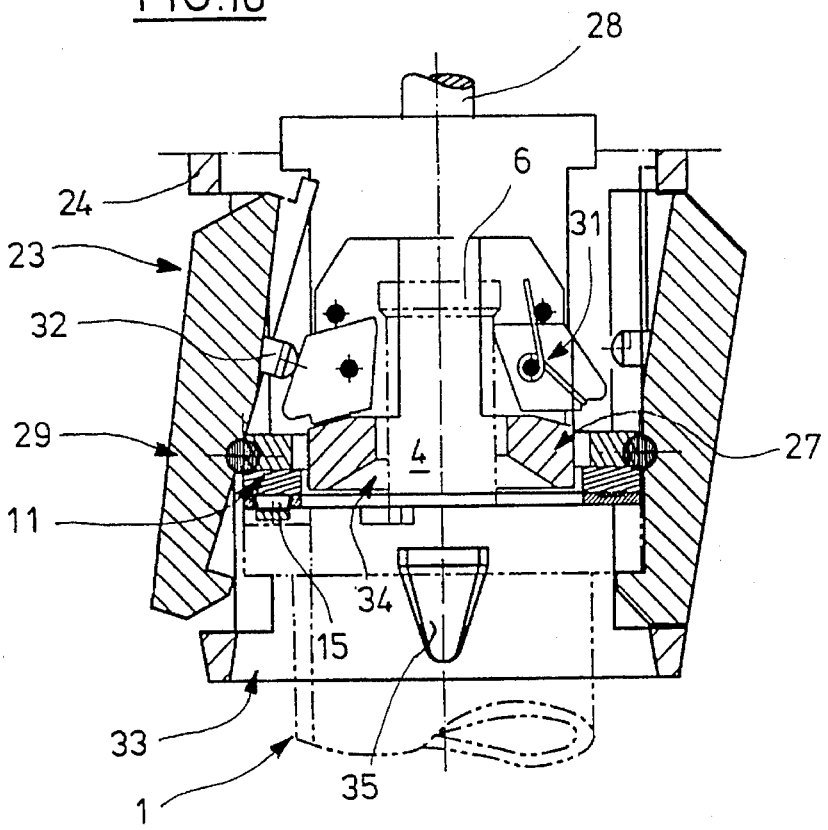
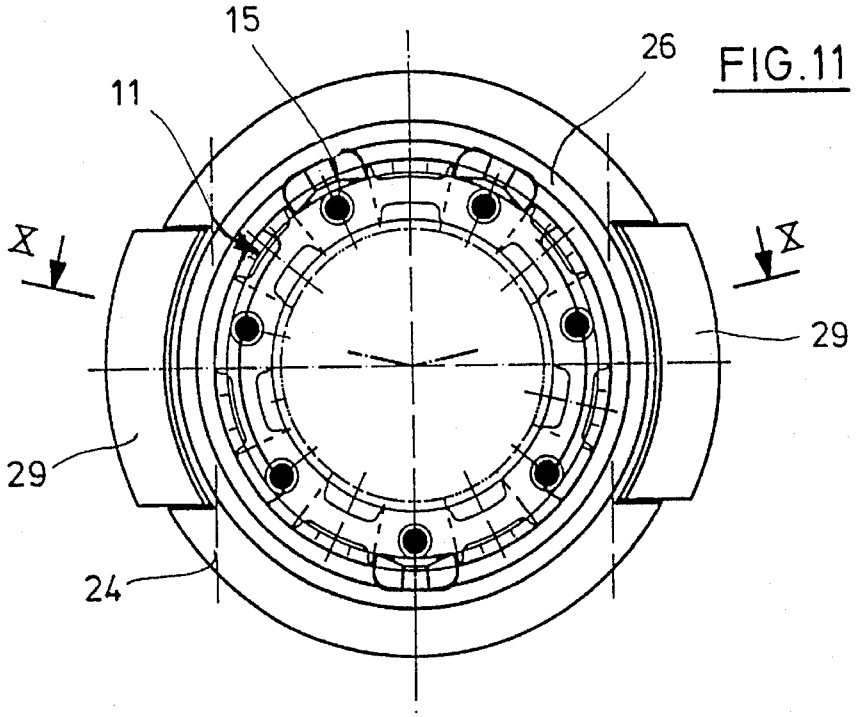
FIG.11

PIPETTE SYSTEM

BACKGROUND OF THE INVENTION

1. Field of the Invention

The object of the invention relates to a pipette system including a syringe having a syringe flange adapted to be received in an accommodation provided in the pipette body, an accommodation body displaceable within the pipette body and having a plunger accommodation for receiving the syringe plunger, and sensing means for detecting information provided on a data carrier associated with the syringe.

2. Description of the Prior Art

Pipette systems of the type referred to at the beginning often are defined as repeating or multipipette systems which allow the gradual delivery of a liquid from a syringe. Such a repeating system is known from the DE-C2 29 26 691 which especially is directed to the repeating mechanism of the repeating pipette. It also describes how to secure a syringe of the system to said repeating pipette. For this purpose, the syringe is provided with a syringe flange adapted to be inserted from the side into a substantially U-shaped groove being open at the side. An axial pressure spring secures the inserted syringe flange to the nut. For the connection of the syringe plunger to a plunger adjusting means an insertion element is provided which receives an end section of the syringe plunger between two jaws. The jaws can be pressed against said syringe plunger by means of a flap-like clamping element, the actuating lever of which projects from the body through an opening.

According to this system, the syringe flange besides may comprise a profiling upon which a spring-actuated lever of the repeating pipette is acting. The lever is connected to the plunger adjusting means and adjusts the dosing volume. Thereat the syringe flange is profiled so that in dependence on its rotary position in its body accommodation different dosage volumes are adjusted. This enables the user to adjust the dosage quantity of the syringe by its rotation in the syringe accommodation. For the same repeating pipette, however, syringes with different absorption capacities are provided. They differ from each other by different cross sections of absorption, with the total length being the same. Identical profilings of the syringe flange of different syringes, therefore, do not allow the dosage quantities to be adjusted coincidently. On the contrary, the use of syringes of different capacities makes a conversion necessary.

As a result of the limited available space the different syringes namely cannot be profiled individually. Moreover, the profiling also allows the adjustment of discrete dosage quantities only. Any intermediate values or values beyond the range of adjustment determined by the profiling cannot be achieved.

Taking all these facts into consideration, it is the object of the invention to provide a pipette system which allows an identification of an inserted syringe or the condition of the same. Especially, the system should allow a simple adjustment of the dosage quantity without making any conversion necessary.

SUMMARY OF THE INVENTION

The object of the invention is achieved by providing axial openings in the syringe flange and plunger accommodations, through which the syringe flange and plunger move into their attachment positions, with the data carrier being formed as a ring supported on the syringe flange and having at least one axially extending sensed area.

According to an inventive pipette system, the syringe comprises a data carrier informing about the syringe and/or the condition thereof. There may be concerned any specific dates of the syringe, such as the syringe volume, or any other constant data. The information may also relate to any other data of the syringe, such as its condition of cleanness or any filling substance. Furthermore, the pipette comprises a sensing means which reads the information on the data carrier. The pipette thus is in the position to identify the syringe associated thereto and/or to determine the condition thereof. Consequently, the inventive pipette system can automatically determine or adjust the respective pipetting parameters. Any time-consuming activities of the user are not necessary therefor any more. Especially, an evaluation means may be provided which, in consideration of a set value of the plunger adjusting means, converts the information read by the sensing means into the value of the actually adjusted dosage quantity. This enables the operator to use the syringe type according to the practical requirements and to adjust the dosage quantity without any time-consuming conversion work. In addition, this allows the continuous selection of the dosage quantity within the dosage area available. Therefor, the plunger adjusting means only need to be adjusted, the dosage quantity being directly displayed by the display means.

According to the physical provision of the information on the data carrier, the sensing means can sense mechanically, electrically, optically, magnetically, inductively, capacitively and/or acoustically. Mechanical, electrical and/or optical modes of operation are acceptable to the evaluation means or display means, too. Thereat a miniaturized electric circuit or a LCD display may be concerned.

The syringe can be connected to the pipette by an all-axial movement, whereby the mutual alignment of the data carrier and the sensing means may be favored. For this purpose, the accommodations for the syringe flange and the syringe plunger are provided with axial openings.

Preferably, the syringe flange of the syringe serves as a data carrier. Any large-volume syringes may be of such a big size that there is required an adapter comprising a syringe flange for fixing them to a pipette. In that case the data carrier can be provided on the syringe flange of the adapter. Preferably, the syringe flange is a syringe flange or an adapter flange which, at the same time, can serve as a data carrier.

The information can be contained in the arrangement and axial position of sensed areas. The sensed areas are arranged within a ring (e.g. as a crenellated ring) to allow the syringe to be inserted into the repeating pipette in different rotary positions. Preferably, only two possible different axial positions on the syringe are provided for all sensed areas. Hereby a binary notation of the information is achieved which makes sensing errors largely impossible. Seven sensed areas altogether allow the representation of a sufficient number of different syringe volumes which fully meets the practical requirements. Thereat any incorrect sensing can be noted as well.

Aligning noses may be provided on the syringe flange and guiding grooves may be provided in the flange accommodation of the repeating pipette for a reproducible alignment of the syringe and its data carrier with the sensing means. Several aligning noses and several guiding grooves allow the user to fix the syringe at any desired angle whereat, after an automatic alignment, the valuation means determines the volume of the syringe, irrespective of the respective angular position. The guides only have to cause the sensing means to be in a correct alignment with the data carrier.

The sensing means may be position sensors for detecting the position of sensed areas. The position sensors may comprise sensing pins which by means of spring means are pressed axially towards the sensed areas of the syringe. Thereat the sensing pins preferably can be pressed axially beyond the flange abutment for the syringe flange.

The conversion of the sensed information into the reading for the dosage quantity may be made all-mechanically. The sensing pins, however, also may be connected to microswitches for making an electronic evaluation. According to a preferred embodiment, the sensing pins are defined as axial knots of an annular disc of elastic soft material such as silicone. At the bottom of a hollow space the knots are provided with an electrically conductive material. The annular disc with its knot-free side is secured to an annular printed board, whereat several printed boards are associated to each knot which printed boards are electrically interconnectable from the electrically conductive material. Thereat the knotted side of the annular disc may be fixed to the printed board by an annular fastening disc having through holes for the knots. In addition, said annular fastening disc protects the knots from an excessive compression by the syringe flange. This sensing means can be manufactured and installed at low cost and features a high operational reliability.

Moreover, the position sensors may be pressure sensor which in a certain position are pressed and switched. Suitable pressure sensors are known from the publication "Touch me—Tastaturen mit Druck- und Positions-sensoren", Konstruktionspraxis No. 5, May 1993, 23rd year, pages 84, 85.

They are also designated as FSR-TM pressure sensors (Force Sensing Resistor Touch me pressure sensors). The basic type thereof comprises two polymer layers which are laminated together. One layer is covered with interdigitating electrodes, the other one with any king of semiconductor material. In a no-load condition the output resistance usually is 1M Ω or more. The output resistance falls to typically 400 to 40 k Ω with the surface being in an on-load condition. This change of the resistance is used as switching commands. Such pressure sensors feature a minimum contact travel only so that, in compensation of any dosage differences, they can be kept in the pipette body while being supported by a spring.

Finally, an embodiment provides a repeating system which allows the sensing, evaluation and/or display means to be retrofitted. The retrofitting, especially, is relevant for electrical systems of the type referred to.

BRIEF DESCRIPTION OF THE DRAWINGS

Further details and advantages of the invention result from the following description of the accompanying drawings which show preferred embodiment.

FIG. 10 shows a section along line X—X of FIG. 11 of the same repeating pipette system, with the actuating means being unactivated (right half) and the actuating means being activated (left half);

FIG. 11 shows a bottom view of the same repeating pipette.

DETAILED DESCRIPTION OF THE PREFERRED EMBODIMENTS

Figure 3:
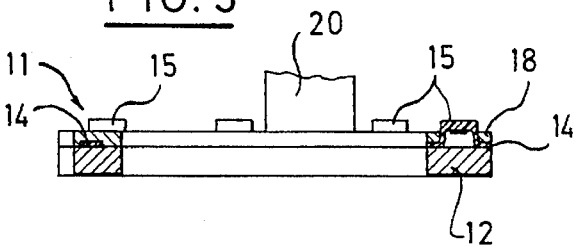
FIG. 3 to 6 shows a cross-section, en enlarged partial section, an underside view and top view of a sensing means comprising a knotted disc for the sensed area ring.
Figure 4:
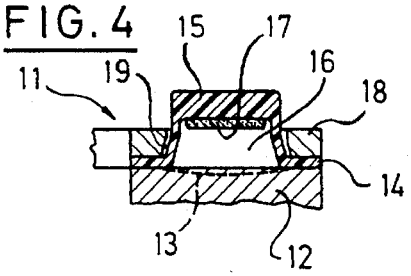
Figure 5:
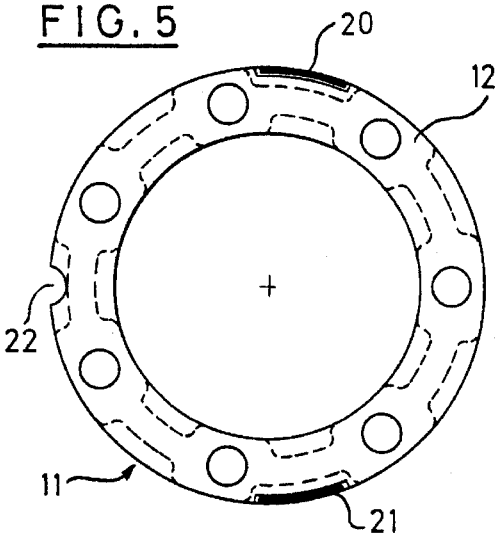
Figure 6:
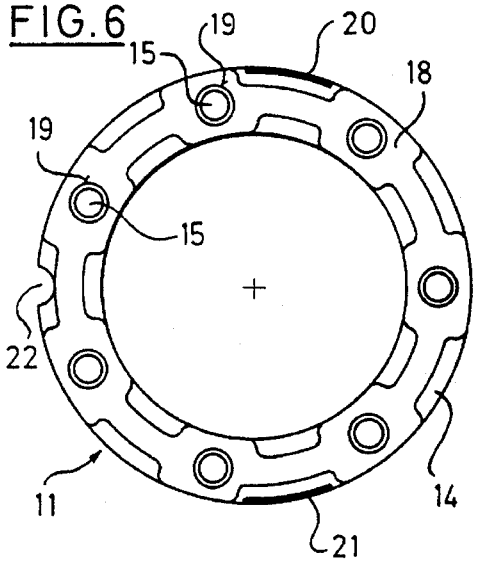
Figure 7:
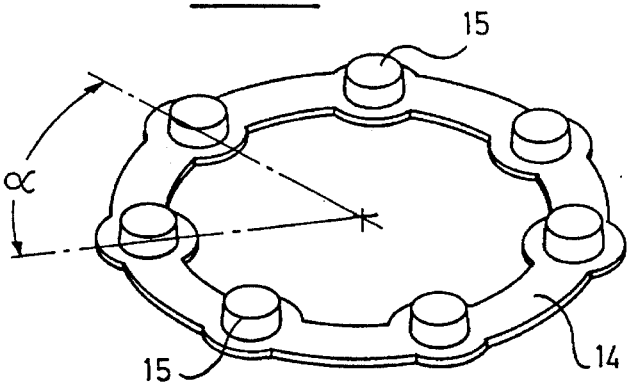
FIG. 7 shows a knotted disc of the same sensing means.
Figure 1:
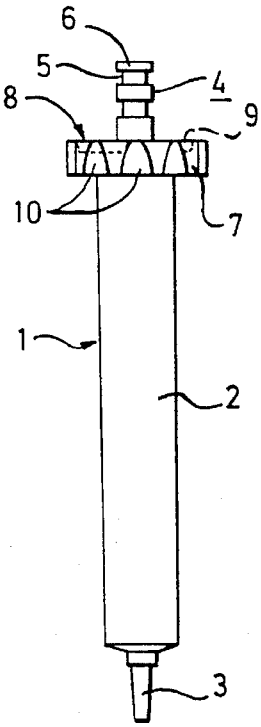
FIG. 1 shows a side view of a syringe comprising a sensed area ring informing about the syringe volume.

FIG. 1 shows a special syringe 1 which allows the absorption capacity to be seen. A cylindrical syringe body 2 is provided in a conventional way which at the bottom comprises a slip-on cone 3 for a syringe. The end of a syringe plunger 4 which is provided with pierces 5 projects from the syringe body 2 above. The upper pierce 5 is limited by a plunger collar 6 above which allows the syringe to be fixed to an accommodation body of a repeating pipette.

Moreover, syringe body 2 comprises a syringe flange 7 at the upper end. The syringe flange 7 has a ring 8 consisting of sensed areas 9 which are defined as upper side recesses. There are two different kinds of sensed areas 9 which correspond to two different depths of said recesses. The different kinds of sensed areas 9 thus differ from each other by their axial position on the syringe body 2. Ring 8 comprises seven sensed areas 9 altogether, the information about the maximum absorption volume of the syringe 1 being contained in the numbers and arrangements of the different recesses.

Figure 2:
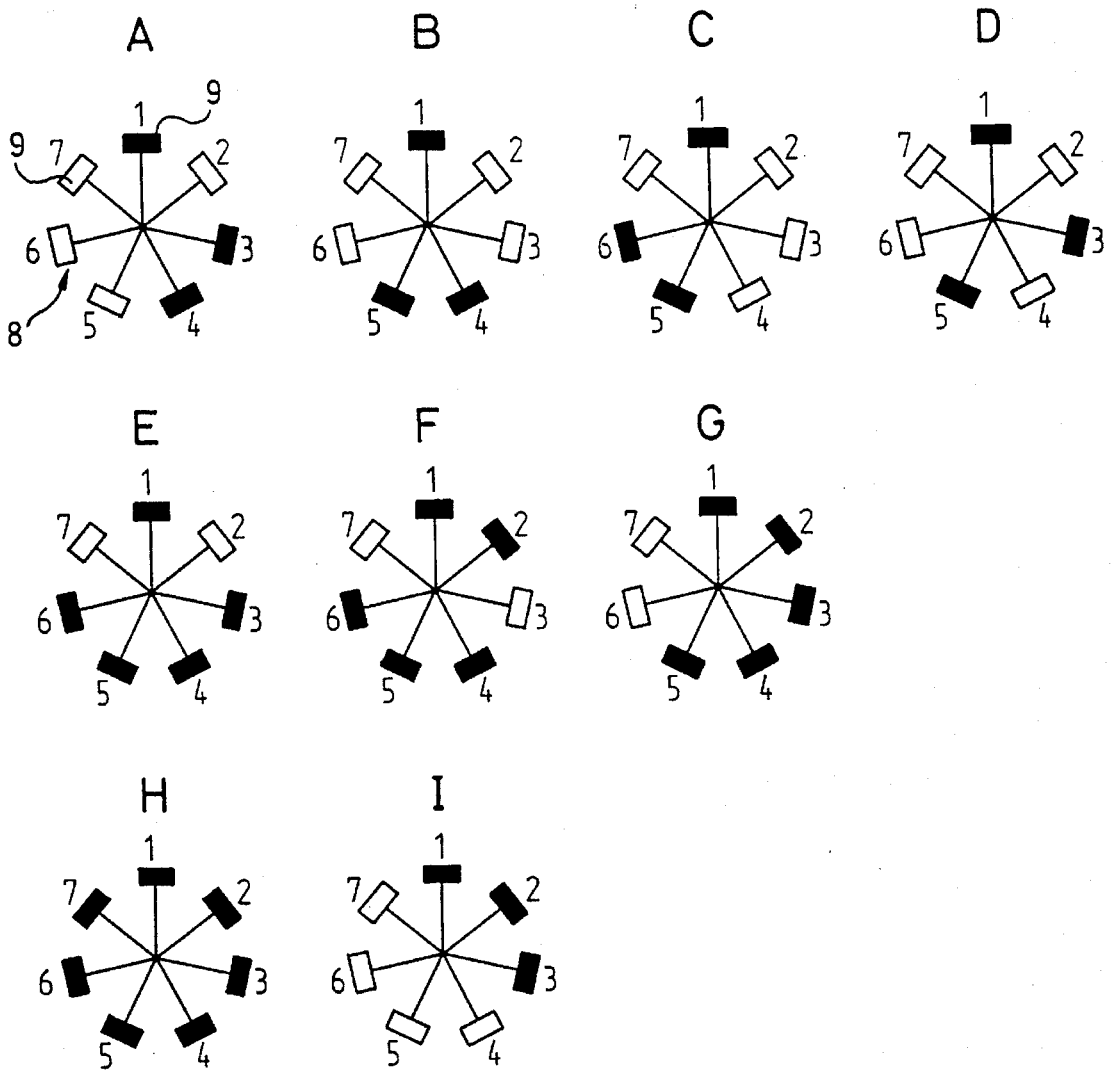
FIG. 2A–2I show a diagrammatic view of codifications of the sensed area rings of syringes of different volumes.
Figure 8:
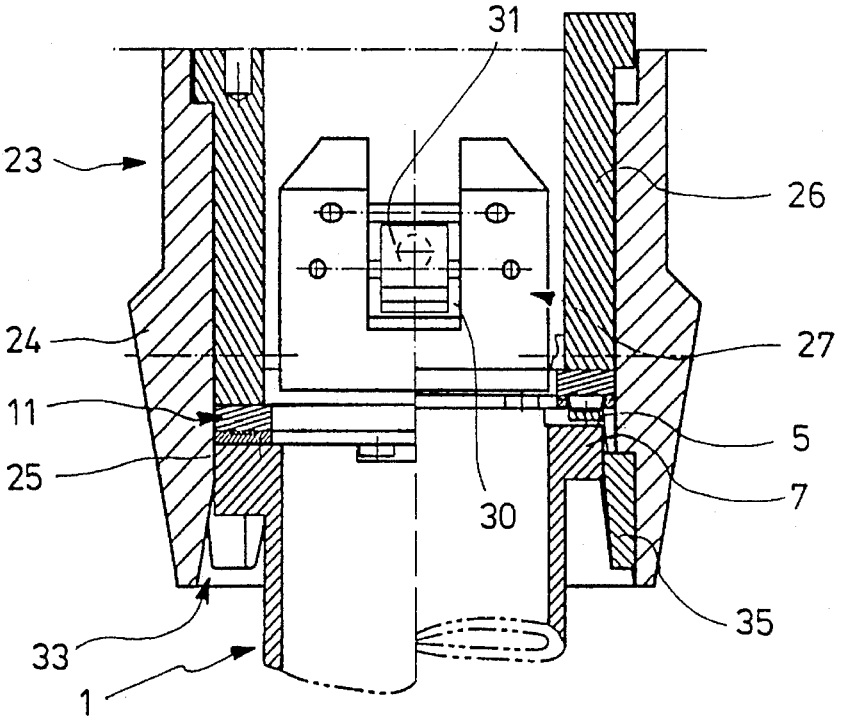
FIG. 8 shows a section taken along line VIII—VIII of FIG. 9 of the bottom part of a repeating pipette comprising sensing means and the upper part of an inserted syringe having a sensed area ring.
Figure 9:
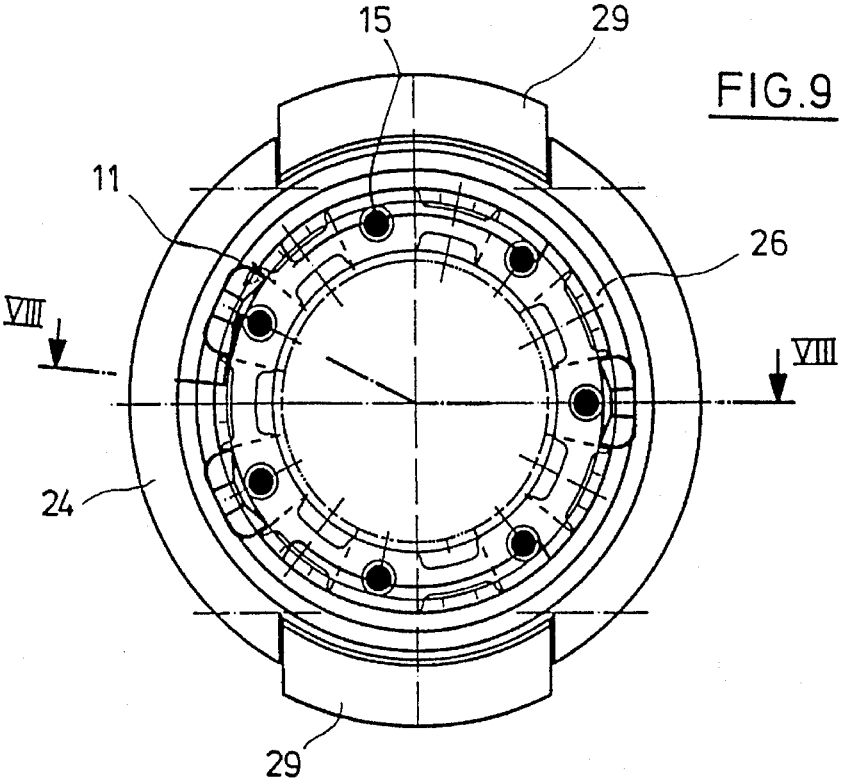
FIG. 9 shows a bottom view of the same repeating pipette, with the syringe being partly inserted (left half) and the syringe being completely inserted (right half)

FIG. 2 with its parts A to I diagrammatically shows the development of various sensed areas 9. Thereat the seven sensed areas 9 are shown rectangularly, while the raised sensed areas which activate a sensing pin 15 of the sensing means 11 are shown blackened. The arrangement of these sensed areas shows a pattern of nine different (A to I) possibilities which, irrespective of the rotary position of the syringe 1 towards the sensing means 11, can be clearly detected and evaluated by the sensing means provided in the repeating pipette 23. At the same time, in view of the fact that there always is to be evaluated an odd number of raised sensed areas only, a false detection in consequence of a defect of a sensing pin 15 of said sensing means 11 may be possible which can be indicated by the display means since the sensing means then will detect an even number of raised areas to be sensed.

As can be seen from FIG. 1 furthermore, the syringe flange comprises aligning noses 10 which taper uwardly. There are provided seven aligning noses 10, each of which being arranged between adjacent sensed areas 9.

A sensing means 11 for the information on the syringe flange 7 will now be explained by means of FIG. 3 to 7. The sensing means 11 comprises an annular printed circuit board 12 having conducting paths 13 at the upper surface. At the side of the conducting paths of the printed circuit board 12 an annular disc 14 of silicone is arranged. The annular disc 14 comprises seven knots 15 which, according to the sensed areas 9 of the syringe 1, are uniformly distributed around the central axis and thus are arranged at an angular distance α of 51.4°. The knots 15 comprise a hollow space 16 which towards the side of the conducting path 13 is open. At the bottom of the hollow space 16 the knots 15 are provided with an electrically conductive material 17 in the form of a conductive dot or a conductive lacquer. Below the electrically conductive material 17 the printed circuit board 12 is provided with various conducting paths 13 which can be electrically connected to each other from the conductive material 17 by axially compressing the knot 15. Knots 15 are elastically compressible so that they spring back to their basic shape after release.

The knotted disc 14 is secured to the printed circuit board 12 by means of an annular fastening disc 18. The annular fastening disc 18 comprises through holes 19 through which the knots 15 do project upwardly.

Conductor connections 20, 21 are led outwardly at opposite edges of the sensing means 11, each of which conductor connection 20, 21 is capable of establishing a number of electric connections. Besides, the sensing means 11 comprises a centering recess 22 on its periphery.

If pressing the sensing means 11 against the upper side of the syringe flange 7 by aligning the knots 15 to the sensed areas 9, the knots 15 are compressed by the less deep sensed areas 9 so as to allow the subjacent conducting paths 13 to be interconnected by the electrically conductive material 17. The remaining knots 15 which penetrate into the deeper recesses are not placed into a corresponding switching condition. The switching conditions of each of the knots 15 and thus the information contained on the syringe flange 7 can be calipered on the electric conductor connections 20, 21.

In FIG. 8 to 11 a repeating pipette system is shown which comprises the sensing means 11 and the corresponding syringe 1. The system comprises a repeating pipette 23 which in a pipette body 24 has an accommodation 25 for the syringe flange 7. In the pipette body 24 above the accommodation 25 a spring-supported abutment 26 is provided which is divided perpendicular to the plane of the drawing.

Moreover, in the pipette body 24 an accommodation body 27 comprising a plunger accommodation (not shown) for the syringe plunger 4 is arranged. The accommodation body 27 is axially displaceable by means of a driving rod 23 and a repeating mechanism (not shown) (e.g. DE-C2 29 26 691).

In radial breakthroughs of the pipette body 24 gripping levers 29 for the syringe flange 7 are arranged so as to face each other diametrically. In addition, in radial breakthroughs 30 of the accommodation body 27 gripping levers 31 for the plunger collar 6 are arranged in positions facing each other diametrically. The syringe gripping levers 29 are provided with cams 32 inside which can be pivoted against the outside of the collar gripping lever 31.

The pipette body 24 comprises an axial opening 33 for the syringe flange 7 and the accommodation body 27 is provided with an axial opening 34 for the plunger 4.

According to this pipette means 23, the sensing means 11 is fixed to the bottom side of the flange abutment 26, with the knots 15 being directed to the axial opening 33 of the body 24. In the proximity of the axial opening 33 the flange accommodation 25 is equipped with guiding grooves 35 between which the aligning noses 10 of the inserted syringe 1 are guided.

The insertion of the syringe 1 into the repeating pipette 23 and the removal therefrom takes place by inserting the syringe 1 with its flange 7 through the axial opening 33 into the flange accommodation 25. At the same time, the syringe plunger 4 is led through the axial opening 34 into the accommodation body 27. In their accommodations 25, 27 the syringe flange 7 and the plunger collar 6 are engaged round and retained by the pretensioned gripping levers 29, 31. The guiding grooves 35 cause the syringe 1 to be aligned during insertion so that each sensed area 9 is associated to exactly one knot 15 of the sending means.

As soon as the syringe flange is fixed to its accommodation by the syringe gripping levers 29 having snapped into place knots 15 of higher sensed areas 9 are compressed so as to get into electric contact while the other knots remain contactless. In consideration of a desired value of the dosage quantity the evaluation and display means (not shown) arranged in the repeating pipette 23 evaluate the switching commands provided by the sensing means 11 and indicate the respective dosage quantity.

The ejection of the syringe 1 takes place by actuating the syringe gripping levers 29 which with their cams 32 pivot the collar gripping levers 31 so as to place them into the release position as well. Thereat the elastic knots 15 return to their undeformed initial position in which they project from their annular fastening disc 18. They then are ready for the detection of another coded syringe 1.

Needless to say that also compatible uncoded syringes can be inserted which can be signalized by the display. If no syringe is inserted the evaluation means becomes aware of this and disconnected the display automatically.

I claim:

1. A pipette system, comprising:

a syringe having a syringe flange and a syringe plunger;

a pipette having a pipette body and an accommodation body displaceable within said pipette body, said pipette body and said accommodation body having flange and plunger accommodations, respectively, for receiving said syringe flange and plunger, respectively, and said flange and plunger accommodations having respective axial circular openings, through which said syringe flange and plunger axially move, respectively, into attachment positions thereof in said pipette;

fastening means for releasably securing said syringe flange and plunger to said flange and plunger accommodations, respectively;

plunger adjusting means for displacing said accommodation body;

a data carrier containing at least one of information characterizing said syringe and information characterizing conditions of said syringe, said data carrier comprising a ring supported on said syringe flange and having at least one axially extending sensed area characterizing an axial position of said syringe and enabling insertion of said syringe into said pipette in different rotational positions; and means provided in said pipette for sensing said sensed area.

2. The pipette system according to claim 1, wherein said sensing means comprises at least one of mechanical, electrical, optical, magnetic, inductive, capacitive, and acaustic sensing elements.

3. The pipette system according to claim 1, further comprising an adapter for connected said syringe flange with said syringe.

4. The pipette system according to claim 1, wherein said at least one sensed area may occupy two different axial positions on said syringe.

5. The pipette system according to claim 1, wherein said ring has seven sensed areas.

6. The pipette system according to claim 1, wherein said syringe flange has at least one aligning nose, and said syringe flange accommodation has at least one guiding groove for receiving said aligning nose.

7. The pipette system according to claim 1, wherein said sensing means comprises a position sensor for detecting said at least one sensed area.

8. The pipette system according to claim 7, wherein said position sensor comprises a sensing pin and a spring for biasing said sensing pin toward said sensed area.

9. The pipette system according to claim 8, wherein said pipette has an abutment for said syringe flange, said spring biasing said sensing pin axially beyond said abutment.

10. The pipette system according to claim 8, further comprising microswitch means connected with said sensing means.

11. The pipette system according to claim 8, wherein said position sensor comprises an annular disc formed of an elastic material, wherein said sensing pin is formed as an axial knot located on said annular disc, said axial knot having a hollow space facing a surface of said annular disc, wherein said position sensor comprises an electrically conductive material located in said hollow space, and wherein said position sensor includes an annular printed circuit board engaging a surface of said annular disc, located on a side remote from said knot, and having conductive path means provided beneath said knot.

12. The pipette system according to claim 11, wherein said position sensor comprises an annular fastening disc for fixing said knot-facing surface of said annular disc to said printed circuit board, said annular fastening disc having a through hole into which said axial knot extends.

13. The pipette system according to claim 7, wherein said position sensor is formed as a pressure sensor actuated by said sensed area in a predetermined position of said syringe.

14. The pipette system according to claim 1, wherein said ring has a plurality of sensed areas, wherein said sensing means comprises position sensor means including a plurality of sensing pins corresponding to said plurality of sensed areas and a corresponding plurality of springs for biasing said sensing pins toward respective sensed areas, and wherein said plurality of sensing pins area formed as axial knots having hollow spaces filled with an electrically conductive material, said position sensor means including an annular disc made of a elastic material, said hollow spaces of said knots facing one side of said annular disc, and said position sensor means having an annular printed circuit board engaging a side of said annular disc remote from said knots and having a plurality of conductive paths arranged below respective knots.

15. The pipette system according to claim 1, further comprising means for evaluating information detected by said sensing means in consideration of a set value of said plunger adjusting means; and display means for displaying a respective dosage quantity.

16. The pipette system according to claim 15 wherein at least one of said evaluating means and said display means comprises, respectively, one of mechanically, electrically and optically operating means.

17. The pipette system according to claim 15, wherein said evaluating means comprises a miniaturized electric circuit.

18. The pipette system according to claim 15, wherein said display means comprises an LCD display.

19. The pipette system according to claim 15, wherein said sensing means, said evaluation means, and said display means are retrofitted.

* * * * *